US006586889B1

(12) United States Patent
Yaniv et al.

(10) Patent No.: US 6,586,889 B1
(45) Date of Patent: Jul. 1, 2003

(54) MEMS FIELD EMISSION DEVICE

(75) Inventors: Zvi Yaniv, Austin, TX (US); Richard Fink, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

(21) Appl. No.: 09/884,780

(22) Filed: Jun. 19, 2001

Related U.S. Application Data

(60) Provisional application No. 60/212,988, filed on Jun. 21, 2000.

(51) Int. Cl.[7] ..... G09G 3/10

(52) U.S. Cl. ..... 315/169.3; 315/169.1; 313/309; 313/495; 345/108

(58) Field of Search ..... 315/169.3, 169.1, 315/169.2; 313/495, 309, 336; 437/228, 901, 927; 345/108; 359/293; 438/20, 28

(56) References Cited

U.S. PATENT DOCUMENTS

| | | | | |
|---|---|---|---|---|
| 3,866,077 A | | 2/1975 | Baker et al. | |
| 4,272,699 A | | 6/1981 | Faubel et al. | |
| 4,728,851 A | | 3/1988 | Lambe | |
| 5,500,142 A | | 3/1996 | Ushida et al. | 252/62.9 R |
| 5,512,793 A | | 4/1996 | Takeuchi et al. | 310/328 |
| 5,517,074 A | | 5/1996 | Van Pelt et al. | 310/328 |
| 5,593,134 A | | 1/1997 | Steber et al. | 251/129.17 |
| 5,607,535 A | | 3/1997 | Tsukada et al. | 156/252 |
| 5,622,748 A | | 4/1997 | Takeuchi et al. | 427/100 |
| 5,633,554 A | | 5/1997 | Kaji | 310/328 |
| 5,643,379 A | | 7/1997 | Takeuchi et al. | 156/89 |
| 5,681,410 A | | 10/1997 | Takeuchi et al. | 156/89 |
| 5,691,593 A | | 11/1997 | Takeuchi et al. | 310/328 |
| 5,726,073 A | * | 3/1998 | Zhang et al. | 437/228 |
| 5,771,321 A | | 6/1998 | Stern | 385/31 |
| 5,773,921 A | | 6/1998 | Keesmann et al. | |
| 5,821,841 A | | 10/1998 | Furlani et al. | 335/229 |
| 5,834,879 A | | 11/1998 | Watanabe et al. | 310/328 |
| 5,860,202 A | | 1/1999 | Okawa et al. | 29/25.35 |
| 5,862,275 A | | 1/1999 | Takeuchi et al. | 385/19 |

(List continued on next page.)

FOREIGN PATENT DOCUMENTS

| | | |
|---|---|---|
| EP | 0 905 737 A1 | 3/1999 |
| EP | 0 951 047 A2 | 10/1999 |
| JP | 58-216327 | 2/1994 |
| JP | 10-050240 | 2/1998 |
| JP | 9-221309 | 6/1998 |
| JP | 10-199398 | 7/1998 |
| JP | 11-111161 | 4/1999 |
| JP | 0 913 508 A2 | 5/1999 |
| JP | 11-135042 | 5/1999 |
| JP | 11-260244 | 9/1999 |
| JP | 11-260249 | 9/1999 |
| JP | 11-297245 | 10/1999 |
| JP | 11-329311 | 11/1999 |
| JP | 11-329312 | 11/1999 |
| WO | WO 98/21736 | 5/1998 |

OTHER PUBLICATIONS

Y. Takeuchi et al., "28.2: Tiled Display Utilizing Ceramic Actuators for Large Area Flat Panels," *SID 01 Digest*, Jun. 5, 2001, pp. 470–473.

*Primary Examiner*—Haissa Philogene
(74) *Attorney, Agent, or Firm*—Kelly K. Kordzik; Winstead Sechrest & Minick P.C.

(57) ABSTRACT

A ceramic actuator array is utilized to move a field emitter material for each pixel or subpixel to a level where an electric field causes electrons to be emitted from the emitter material towards a phosphor layer in an anode for that particular pixel. When the actuator is in an off state, then the field emitter material is removed to a different level where electrons are not urged to escape from the field emitter material. Thus, a display can be created using such an actuator array with field emitter materials deposited on each actuator element where each actuator element is individually controlled.

11 Claims, 3 Drawing Sheets

U.S. PATENT DOCUMENTS 5,903,098 A * 5/1999 Jones ..... 313/309
5,912,526 A 6/1999 Okawa et al. ..... 310/328
6,005,351 A * 12/1999 Sverdrup et al. ..... 315/169.1
6,031,657 A * 2/2000 Robinson et al. ..... 345/108
6,084,338 A * 7/2000 Bojkov et al. ..... 313/309
6,097,138 A 8/2000 Nakamoto
6,107,732 A * 8/2000 Tolt ..... 313/495
6,111,818 A 8/2000 Bowen et al. ..... 367/140
6,230,378 B1 5/2001 Cramer et al. ..... 29/25.35
6,232,701 B1 5/2001 Schuh et al. ..... 310/328
6,239,547 B1 5/2001 Uemura et al.
6,265,466 B1 7/2001 Glatkowski et al.
6,359,383 B1 3/2002 Chuang et al.
6,380,671 B1 4/2002 Lee

* cited by examiner

MEMS FIELD EMISSION DEVICE

CROSS-REFERENCE TO RELATED APPLICATION

The present application is a continuation-in-part of U.S. Provisional Patent Application Ser. No. 60/212,988 Jun. 21, 2000 entitled "FIELD EMISSION DISPLAY STRUCTURE AND OPERATION."

TECHNICAL FIELD

The present invention relates in general to display devices, and in particular, to field emission display devices.

BACKGROUND INFORMATION

Field emission displays have been previously described as being structured in either diode or triode modes. In a diode mode, the cathode is separated from the anode by a gap. The value of the gap is determined by considering the operating voltage of the phosphor and the turn-on electric field of the electron emitter material (cold cathode). Diode displays can be made with either microtip cathodes or with flat emitters such as carbon-based films. During operation, the gap is fixed by spacers, and the electric current to the phosphor is switched on and off by swing voltages between the anode and cathode. In a passive matrix drive mode, the pixel is off at one-half of the on voltage.

In a triode mode, a grid separates the cathode from the anode. All microtip devices operate in this mode. A triode mode allows a greater degree of flexibility in terms of operating parameters, and the switching voltages can be very low relative to the diode display. In the triode display, a small gap separates the cathode from the grid electrode. This gap is held constant, and the current from the cathode is switched on and off by switching the voltage between the grid and the cathode. The grid allows a significant fraction of the electrons to pass through before they arc and then accelerate to the anode. The acceleration voltage can be very large (5–10 kilovolts or higher) to achieve high phosphor efficiency.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
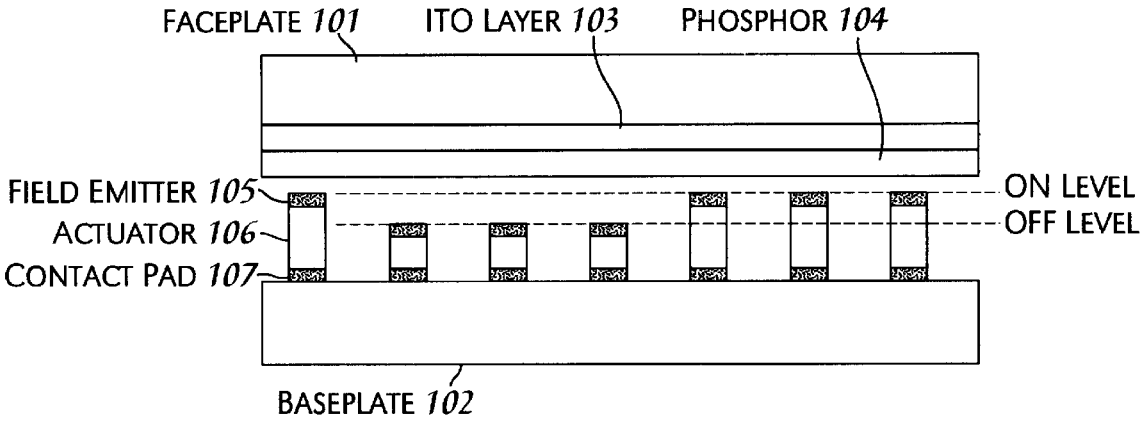
FIG. 1 illustrates an embodiment of the present invention in a diode configuration.

In the following description, numerous specific details are set forth such as specific field emitter materials, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring to FIG. 1, there is illustrated a cross-section of a portion of a display of an embodiment of the present invention in a diode configuration, wherein the diode field emission display is operated by changing the gap between the field emitter (cathode) and the anode, and thus keeping the voltage of the electric field constant. However, note that the principles of the present invention are also applicable where both the gap and the voltage of the electric field are modified. The present invention makes use of a ceramic actuator array, such as disclosed within U.S. Pat. No. 5,862,275, which is hereby incorporated by reference herein. Note, any such ceramic/piezoelectric/electrostrictive actuator array may be utilized to implement the principles of the present invention.

With such an actuator array, the cold cathode field emitter material, 105 can be deposited on the upper face of each of the actuators 106. The present invention is not limited to any one particular field emitter material. Contact pad 107 may contain a piezoelectric layer or some other well known material for assisting in the actuating of the actuator 106.

A display can be made by placing the actuator array on a base plate 102 and a predetermined distance away from an anode face plate 101 having an indium tin oxide ("ITO") layer 103 and a phosphor layer 104. The operating voltages are correlated to the distance the actuator can swing from the off level to the on level and the current/voltage (I–V) characteristics of the cold cathode. In other words, the I–V characteristics of the cold cathode field emitter 105 allow the pixel to be on at a distance equal to the gap plus/minus the actuator swing and off at a distance equal to the gap only (or vice versa). Each of the actuators can be individually controlled so that they operate as pixels and even subpixels for displaying images when actuated to an on level so that electrons are emitted towards the phosphor layer 104.

Figure 2:
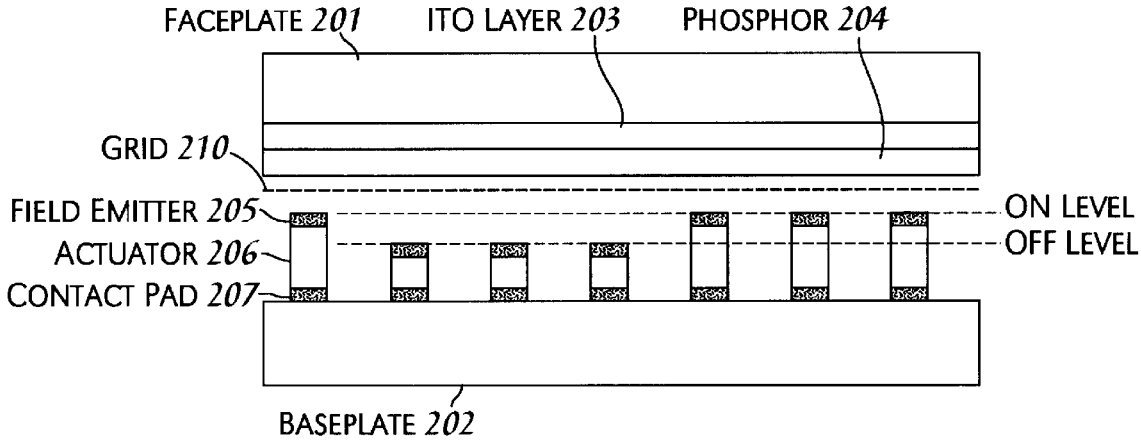
FIG. 2 illustrates a configuration of the present invention in a triode configuration.

Referring to FIG. 2, there is illustrated a triode display utilizing the actuator array as described above with respect to FIG. 1. Each of the elements in FIG. 2 corresponding to the elements in FIG. 1 operate in a similar manner. However, in the triode embodiment, the actuator puts each of its associated field emitters 205 away and towards the grid 210 to turn each pixel on and off (or vice versa). By placing the grid close to the cathode, small changes in the-gap can lead to large changes in current. Again, the triode configuration of FIG. 2 must be compatible with the I–V characteristics of the field emitter material 205 utilized within the display.

Figure 3:
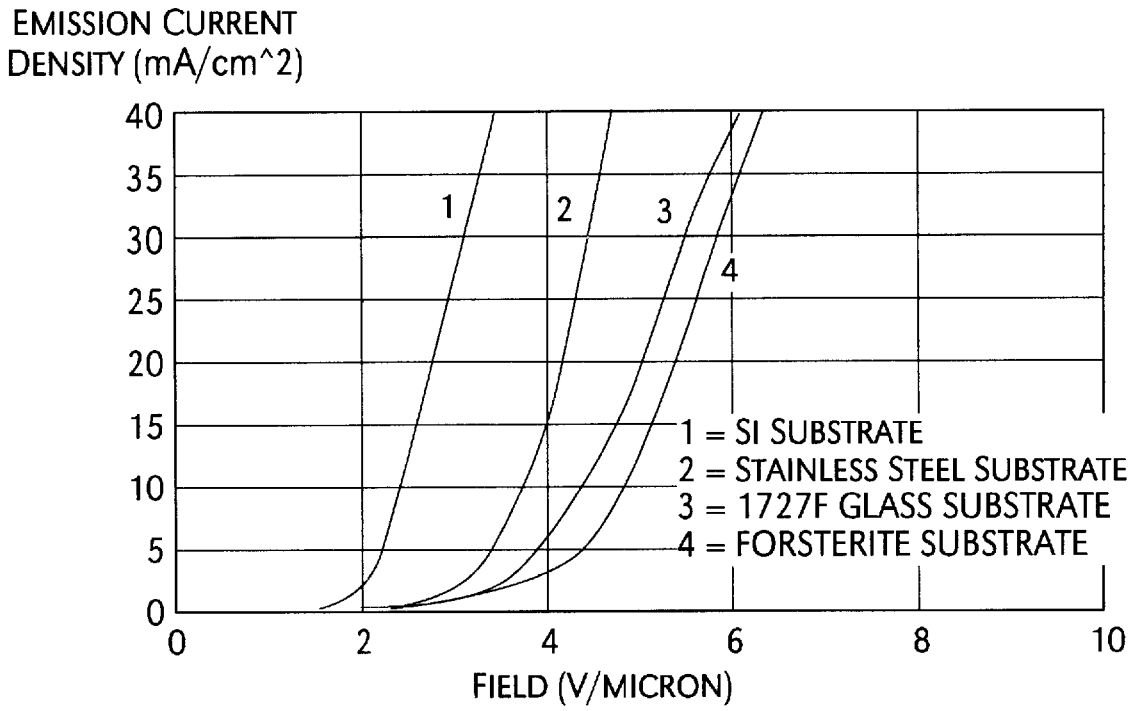
FIG. 3 illustrates a graph of emission current density versus electric field for various carbon films on substrates, which can be utilized in embodiments of the present invention.

Examples of I–V curves for carbon films are illustrated in FIG. 3.

Naturally, other configurations can be implemented using the concepts of the present invention where more than one grid is utilized.

Well known methods for driving matrix addressable displays can be utilized for the driver technology with the display devices described herein. A display can then be created that can be utilized in any apparatus requiring the display of information, including any data processing system, such as described below with respect to FIG. 4.

Figure 4:
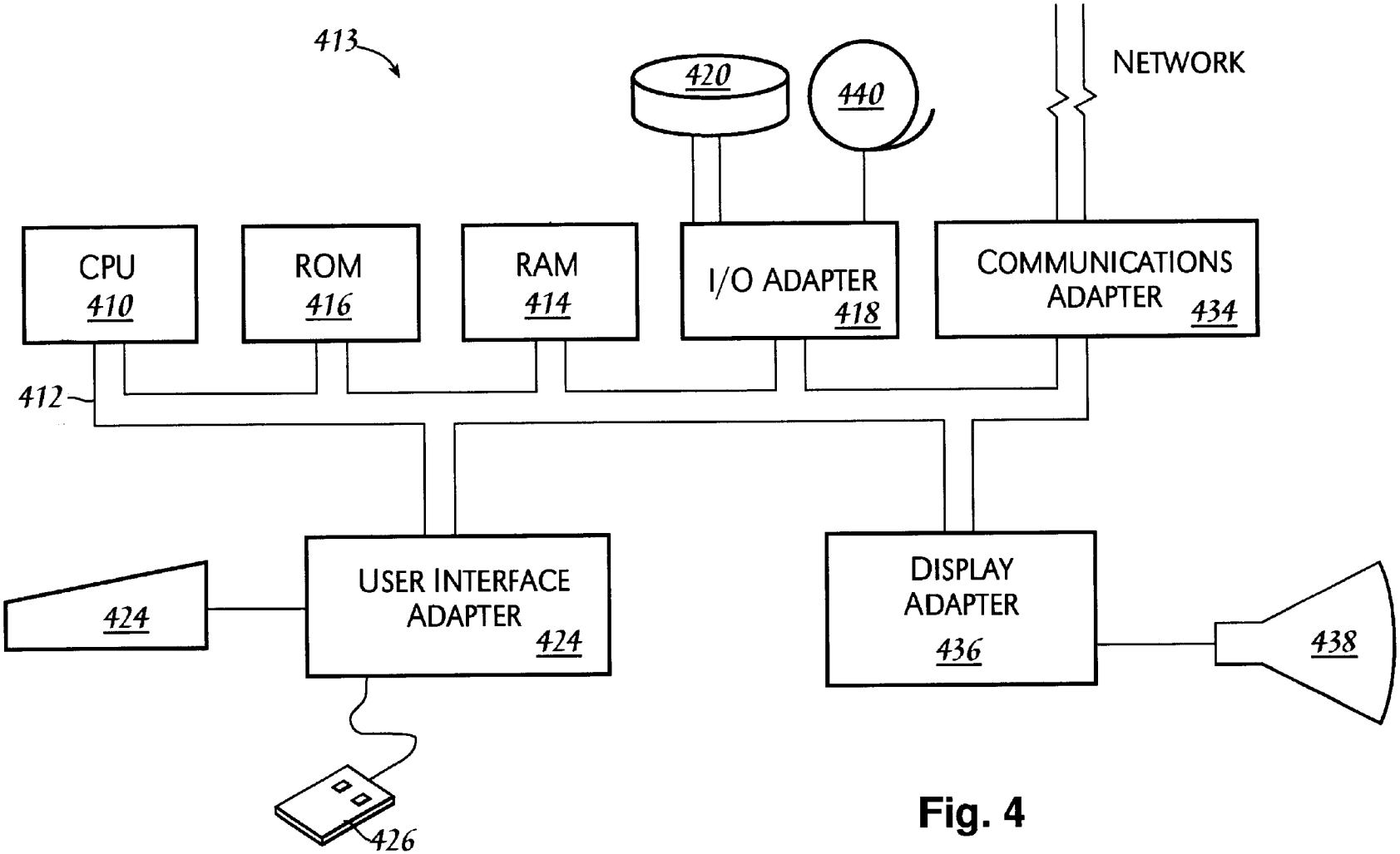
FIG. 4 illustrates a data processing system configured in accordance with the present invention.

A representative hardware environment for practicing the present invention is depicted in FIG. 4, which illustrates an exemplary hardware configuration of data processing system 413 in accordance with the subject invention having central processing unit (CPU) 410, such as a conventional microprocessor, and a number of other units interconnected via system bus 412. Data processing system 413 includes random access memory (RAM) 414, read only memory (ROM) 416, and input/output (I/O) adapter 418 for connecting peripheral devices such as disk units 420 and tape drives 440 to bus 412, user interface adapter 422 for connecting keyboard 424, mouse 426, and/or other user interface devices such as a touch screen device (not shown) to bus 412, communication adapter 434 for connecting data processing system 413 to a data processing network, and display adapter 436 for connecting bus 412 to display device 438. Display device 438 will incorporate the display technology of the present invention. CPU 410 may include other circuitry not shown herein, which will include circuitry commonly found within a microprocessor, e.g., execution unit, bus interface unit, arithmetic logic unit, etc. CPU 410 may also reside on a single integrated circuit.

Although the present invention and its advantages have been described in detail, it should be understood that various changes, substitutions and alterations can be made herein without departing from the spirit and scope of the invention as defined by the appended claims.

What is claimed is:

1. A field emission cathode comprising:

an actuator;

a field-emitter material on a surface of the actuator; and circuitry for causing the actuator to move between first and second positions, where in the first position the field emitter material is not emitting electrons, and where in the second position the field emitter material is emitting electrons.

2. The field emission cathode as recited in claim 1, further comprising circuitry for establishing an electric field, wherein when the actuator is in the first position the field emitter material is positioned relative to the electric field so that the electric field does not cause an emission of electrons from the field emitter material, and wherein when the actuator is in the second position the field emitter material is positioned relative to the electric field so that the electric field does cause an emission of electrons from the field emitter material.

3. A field emission display comprising:

a cathode;

an actuator on the cathode;

a field emitter material on the actuator;

a phosphor material; and circuitry for moving the actuator to first and second positions, wherein in the first position the field emitter material is caused to emit electrons towards the phosphor material which emits light in response to receipt of the electrons, and wherein in the second position the field emitter material is caused to not emit electrons towards the phosphor material.

4. The field emission display as recited in claim 3, wherein in the first position an electric field causes the field emitter material to emit the electrons.

5. The field emission display as recited in claim 3, further comprising circuitry for establishing an electric field, wherein when the actuator is in the first position the field emitter material is positioned relative to the electric field so that the electric field does cause an emission of electrons from the field emitter material, and wherein when the actuator is in the second position the field emitter material is positioned relative to the electric field so that the electric field does not cause an emission of electrons from the field emitter material.

6. The field emission display as recited in claim 5, wherein the phosphor material is deposited on an anode, and wherein the electric field is established between the anode and the cathode.

7. The field emission display as recited in claim 5, further comprising a grid, wherein the electric field is established between the grid and the cathode.

8. A data processing system comprising:

a processor;

a memory device;

an input device;

a display device; and a bus system coupling the processor to the memory device, the input device, and the display device, wherein the display device further includes:

an anode having a transparent substrate with a phosphor layer deposited thereon;

a cathode positioned a predetermined distance from the anode, wherein the cathode further includes an array of actuators, each having a field emitter deposited on a surface thereof;

circuitry for establishing an electric field; and circuitry for independently controlling movement of each of the actuators.

9. The system as recited in claim 8, wherein the controlling circuitry controls movement of each actuator between first and second positions, wherein in the first position the field emitter is caused by the electric field to emit electrons towards the phosphor layer which emits light in response to receipt of the electrons, and wherein in the second position the field emitter is caused to not emit electrons towards the phosphor layer.

10. The system as recited in claim 9, wherein the electric field is established between the anode and the cathode.

11. The system as recited in claim 9, further comprising a grid, wherein the electric field is established between the grid and the cathode.

* * * * *

UNITED STATES PATENT AND TRADEMARK OFFICE

CERTIFICATE OF CORRECTION

PATENT NO. : 6,586,889 B1 
DATED : July 1, 2003
INVENTOR(S) : Zvi Yaniv and Richard Fink It is certified that error appears in the above-identified patent and that said Letters Patent is hereby corrected as shown below:

Column 2,
Line 26, following "material" please delete ",".

Column 3,
Line 31, following "field" please delete "-".

Signed and Sealed this

Second Day of December, 2003

JAMES E. ROGAN
*Director of the United States Patent and Trademark Office*